US008912867B2

(12) United States Patent
Frenna

(10) Patent No.: US 8,912,867 B2
(45) Date of Patent: Dec. 16, 2014

(54) WAVEGUIDE FILTER HAVING COUPLING SCREWS

(75) Inventor: Giuseppe Frenna, St. Laurent (CA)

(73) Assignee: Apollo Microwaves, Ltd., Dorval, Quebec (CA)

( * ) Notice: Subject to any disclaimer, the term of this patent is extended or adjusted under 35 U.S.C. 154(b) by 320 days.

(21) Appl. No.: 13/325,391

(22) Filed: Dec. 14, 2011

(65) Prior Publication Data

US 2012/0293282 A1 Nov. 22, 2012

Related U.S. Application Data

(60) Provisional application No. 61/487,174, filed on May 17, 2011.

(51) Int. Cl.
*H01P 1/20* (2006.01)
*H01P 1/207* (2006.01)

(52) U.S. Cl.
CPC ..... *H01P 1/207* (2013.01)
USPC ..... 333/202; 333/208; 333/209

(58) Field of Classification Search
USPC ..... 333/202, 208, 209
See application file for complete search history.

(56) References Cited

U.S. PATENT DOCUMENTS

| | | | | |
|---|---|---|---|---|
| 4,028,652 | A * | 6/1977 | Wakino et al. | 333/209 |
| 4,686,496 | A | 8/1987 | Syrett et al. | |
| 4,746,883 | A * | 5/1988 | Sauvage et al. | 333/202 |
| 5,389,903 | A | 2/1995 | Piirainen | |
| 5,406,234 | A | 4/1995 | Willems | |
| 5,543,758 | A | 8/1996 | Wey | |
| 5,585,331 | A | 12/1996 | Mansour et al. | |
| 6,304,160 | B1 | 10/2001 | Loi et al. | |
| 6,392,506 | B2 | 5/2002 | Wulff | |
| 6,870,443 | B2 | 3/2005 | Stenberg et al. | |
| 7,142,837 | B1 | 11/2006 | Small | |
| 7,456,712 | B1 | 11/2008 | Henault et al. | |
| 2002/0190817 | A1 | 12/2002 | Berry et al. | |
| 2004/0041661 | A1 | 3/2004 | Yamakawa et al. | |
| 2005/0270120 | A1 | 12/2005 | Guo | |
| 2010/0244982 | A1 | 9/2010 | Di et al. | |

FOREIGN PATENT DOCUMENTS

WO 01/78370 A2 10/2001

OTHER PUBLICATIONS

Marcuvitz, M., "Structure of Variable thickness—Post of variable height in rectangular guide", The Waveguide Handbook, Published by Peter Peregrinus Ltd. London, UK. IEE Electromagnetic Waves Series 21, pp. 271-273.

* cited by examiner

*Primary Examiner* — Robert Pascal
*Assistant Examiner* — Kimberly Glenn
(74) *Attorney, Agent, or Firm* — Kolisch Hartwell, P.C.

(57) ABSTRACT

A waveguide filter, comprising a housing defining a passage through which electromagnetic waves can travel and a plurality of adjustable projections extending through the housing into the passage. The passage is absent any fixed protrusions. The plurality of adjustable projection s comprises a set of coupling projections, wherein each pair of adjacent coupling projections in the set of coupling projections defines there between a resonant cavity. Each coupling projection in the set of coupling projections acts as a coupling element for at least one resonant cavity and is adjustable for trimming the coupling of that at least one resonant cavity. The plurality of adjustable projections further comprises a set of tuning projections, wherein a tuning projection from the set of tuning projections is positioned between each pair of adjacent coupling projections and is adjustable for trimming a resonance frequency of an associated resonant cavity.

22 Claims, 9 Drawing Sheets

WAVEGUIDE FILTER HAVING COUPLING SCREWS

CROSS-REFERENCE TO RELATED APPLICATIONS

This application claims the benefit under 35 USC §119(e) of U.S. provisional patent application Ser. No. 61/487,174 filed May 17, 2011. The contents of the above-mentioned patent application are incorporated herein by reference.

FIELD OF THE INVENTION

The present invention relates to the field of waveguide filters, and more specifically to waveguide filters that comprise tuning screws for forming the coupling elements between resonant cavities, trimming the couplings and trimming the resonance frequencies of the resonant cavities.

BACKGROUND OF THE INVENTION

Waveguide bandpass filters are known in the art and are commonly used in microwave equipment for communications and military applications. Waveguide bandpass filters help to eliminate undesired radiation and unwanted frequencies that can cause interference, by rejecting and/or reducing these unwanted frequencies from a desired frequency passband that is allowed to travel through the waveguide bandpass filter.

Waveguide bandpass filters are generally constructed out of rectangular tubes into which two or more resonant cavities are formed. The resonant cavities are coupled together such that electromagnetic waves within a desired frequency passband can be transmitted through the waveguide bandpass filter. Shown in FIG. 1 is a cross-sectional diagram of an existing type of direct-coupled bandpass filter 4 that is known in the prior art. Included within the filter 4 are resonant cavities 6 that are positioned between two adjacent coupling elements 8. The coupling elements 8 are formed by irises. However, other coupling structures are also known in the art, such as posts, dents or holes. Once constructed, in order to obtain precision coupling, tuning of the couplings often needs to be performed. It is thus known to provide coupling screws that extend beside/between the walls of the irises, in order to be able to trim the coupling and obtain the precision coupling that is desired between two resonant cavities. Tuning screws are then positioned within the resonant cavities 6, between two coupling elements 8, for trimming the resonant frequencies of the resonant cavities 6.

In general, waveguide bandpass filters are quite costly to manufacture, as they can require complex machining and soldering operations in order to get the exact shapes and configurations necessary to achieve the coupling and tuning of the resonant cavities. Accordingly, there is a need in the industry for an improved waveguide bandpass filter that is less costly and less complicated to manufacture, such that it alleviates, at least in part, the deficiencies of existing waveguide passband filters.

SUMMARY OF THE INVENTION

In accordance with a first broad aspect, the present invention provides a waveguide filter, comprising a pair of coupling screws defining there between a resonant cavity and a tuning screw positioned between the pair of adjacent coupling screws. The pair of coupling screws forms coupling elements for the resonant cavity and each coupling screw is adjustable for trimming the coupling. The tuning screw is adjustable for trimming a resonance frequency of the resonant cavity.

In accordance with a second broad aspect, the present invention provides a waveguide filter comprising at least two resonant cavities and a tuning screw associated with each respective one of the at least two resonant cavities. Each resonant cavity of the at least two resonant cavities is positioned between two adjustable projections. The adjustable projections form the coupling elements for the at least two resonant cavities and are adjustable for trimming the couplings. The tuning screws that are associated with each respective one of the at least two resonant cavities are adjustable for trimming a resonance frequency of an associated resonant cavity.

In accordance with a third broad aspect, the present invention provides a waveguide filter, comprising a housing defining a passage through which waves can travel and a plurality of adjustable projections extending through the housing into the passage. The passage is absent any fixed protrusions. The plurality of adjustable projections comprises a set of coupling projections, wherein each pair of adjacent coupling projections in the set of coupling projections defines there between a resonant cavity. Each coupling projection in the set of coupling projections acts as a coupling element for at least one resonant cavity and is adjustable for trimming the coupling of that at least one resonant cavity. The plurality of adjustable projections further comprises a set of tuning projections, wherein a tuning projection from the set of tuning projections is positioned between each pair of adjacent coupling projections and is adjustable for trimming a resonance frequency of an associated resonant cavity.

In accordance with a third broad aspect, the present invention provides a method comprising placing a plurality of adjustable projections within pre-defined apertures of a waveguide filter housing that defines a passage through which electromagnetic waves can travel. The passage is absent any fixed protrusions. The plurality of adjustable projections comprises a set of coupling projections and a set of tuning projections, wherein the set of coupling projections are placed within alternating ones of the pre-defined apertures for defining there between resonant cavities. The set of tuning projections are placed within the remaining pre-defined apertures located between adjacent ones of the coupling projections. The method further comprises adjusting the positioning of at least some of the coupling projections of the set of coupling projections for trimming resonant cavity couplings of at least some of the resonant cavities and adjusting the positioning of at least some of the tuning projections of the set of tuning projections for trimming a resonant frequency of at least some of the resonant cavities.

Other aspects and features of the present invention will become apparent to those ordinarily skilled in the art upon review of the following description of specific embodiments of the invention in conjunction with the accompanying figures.

DETAILED DESCRIPTION

Figure 1:
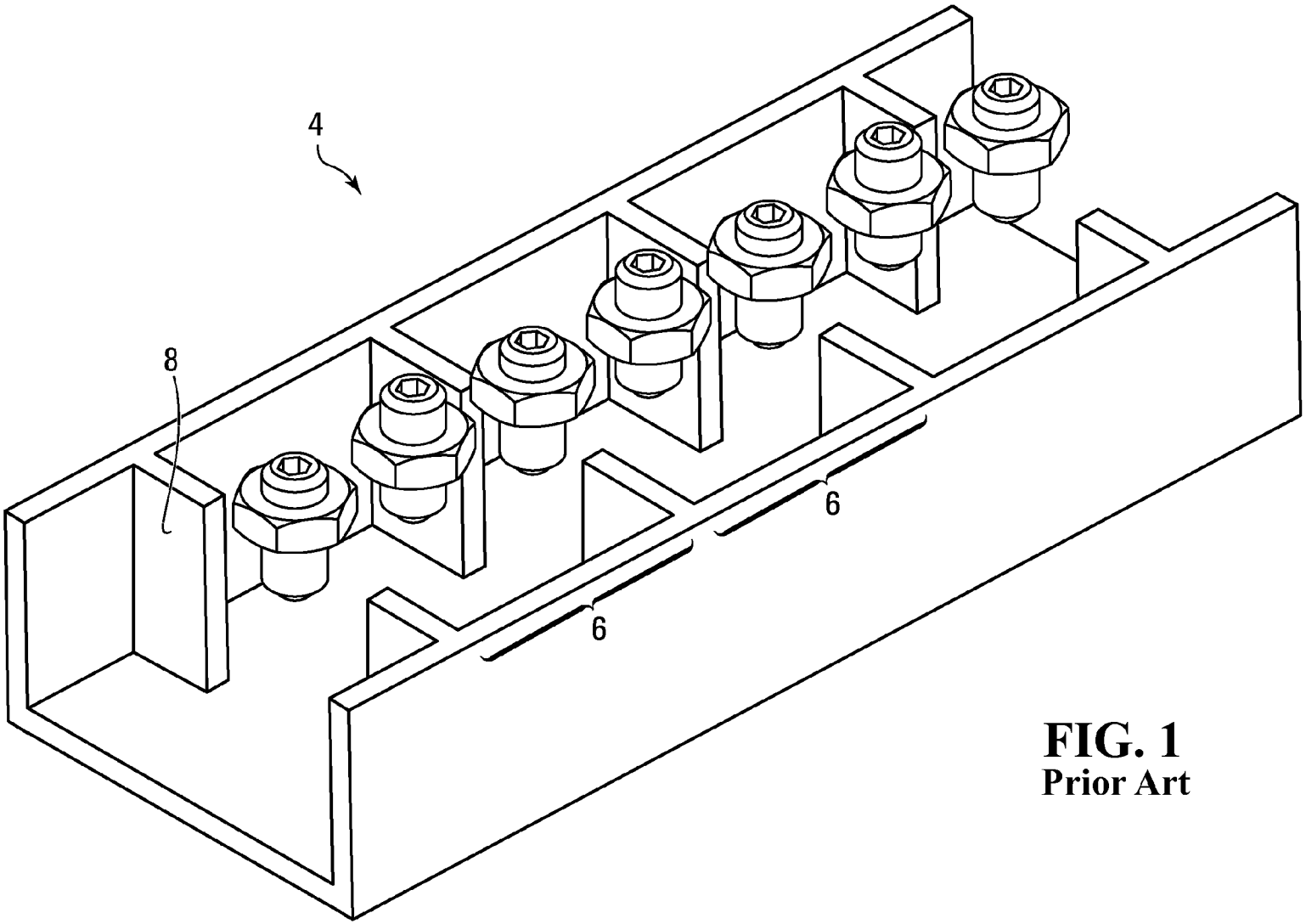
FIG. 1 Prior Art
FIG. 1 shows a known waveguide bandpass filter in accordance with the prior art.
Figure 2:
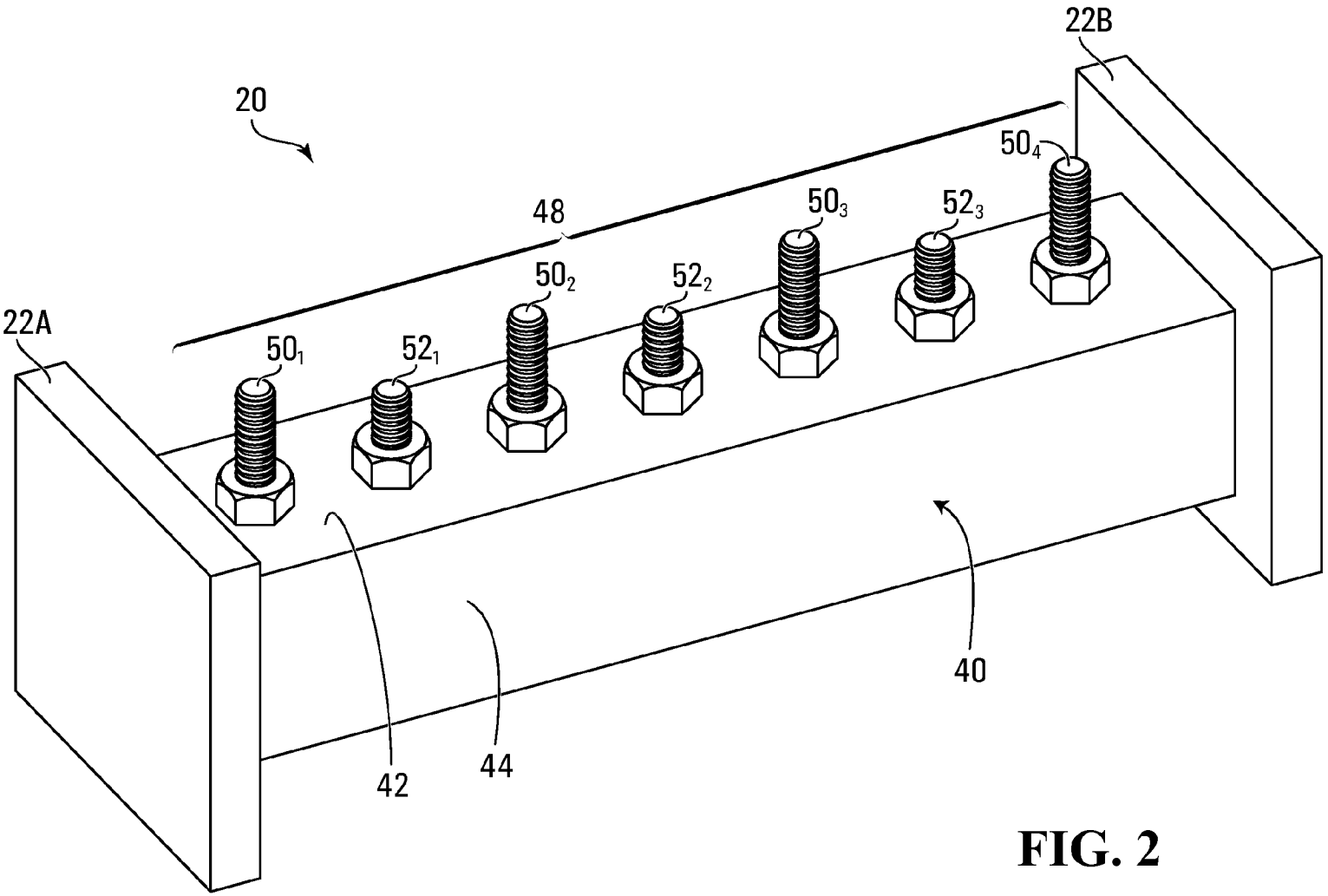
FIG. 2 shows a perspective view of a non-limiting example of implementation of a waveguide bandpass filter in accordance with the present invention.

A waveguide bandpass filter 20 in accordance with a first non-limiting example of implementation of the present invention is shown in FIG. 2. The waveguide bandpass filter 20 comprises a housing 40 that forms a transmission line through which electromagnetic waves that are at microwave frequencies are able to travel. Positioned on either side of the waveguide bandpass filter 20 are flanges 22A, 22B for connecting the bandpass filter 20 to other microwave components, such as transmitters, receivers, and antennas, among other possibilities. For example, the waveguide bandpass filter 20 can be used to connect a microwave transmitter and/or receiver to an antenna.

The waveguide bandpass filter 20 is able to propagate electromagnetic waves having frequencies within a desired bandpass frequency range, and reject/attenuate waves having frequencies outside that frequency range. In this manner, waves having unwanted frequencies are suppressed such that they are not further propagated through the microwave equipment causing interference.

The housing 40 of the waveguide bandpass filter 20 shown in FIG. 2 is a rectangular tube that defines a passage through which waves having a desired passband frequency are able to travel. Although the bandpass filter 20 shown in FIG. 2 is a non-square rectangular tube, in other embodiments, the bandpass filter 20 may be formed of a square tube. Included within the passage of the bandpass filter 20 are at least two resonant cavities (not shown in FIG. 2) that allow the waveguide bandpass filter 20 to transmit electromagnetic waves having frequencies that are within a desired bandpass frequency range, and reject/attenuate those waves that don't. The resonant cavities have interior surfaces that reflect waves having a specific frequency. When a wave that is resonant with the resonant cavities enters the housing 40, the waves bounce back and forth within the cavities with low energy loss such that they are transmitted through the housing 40.

As shown in FIG. 2, the housing 40 has a rectangular shape, defined by two wide walls 42 that are positioned opposite one another, and two narrow walls 44 that are positioned opposite one another. In general, the ratio of the width of the wide walls 42 to the width of the narrow walls 44 will be in the order of 2:1. However, other dimensions for the housing 40 of a waveguide filter are known in the art and are included within the scope of the present invention.

A plurality of adjustable projections 48, which are depicted as threaded rods and nuts in the non-limiting embodiment shown, extend through one of the wide walls 42 into the internal passage (not shown). These threaded rods and nuts are commonly referred to as screws in the industry. As will be described in more detail below, the plurality of projections 48 comprises a set of coupling projections $\mathbf{50}_1$-$\mathbf{50}_4$ (which will be collectively referred to as coupling projections 50) and a set of tuning projections $\mathbf{52}_1$-$\mathbf{52}_3$ (which will be collectively referred to as tuning projections 52). As shown, the coupling projections 50 are arranged in an alternating fashion with the tuning projections 52, such that a tuning projection 52 is positioned between each pair of adjacent coupling projections 50.

Figure 3:
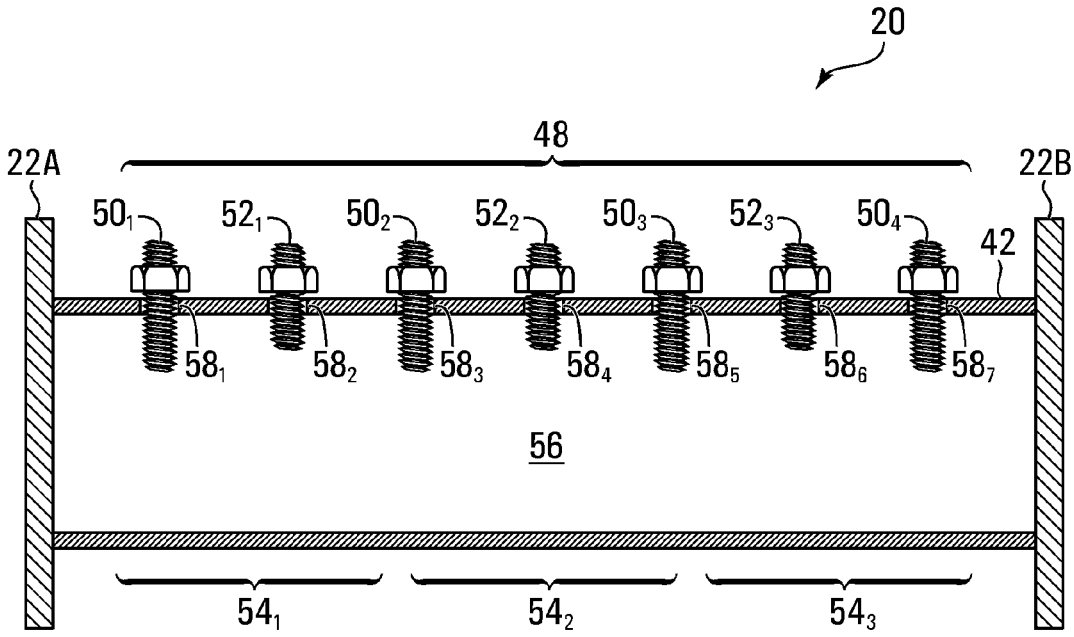
FIG. 3 shows a cross-sectional view of the waveguide bandpass filter of FIG. 2.

Shown in FIG. 3, is a cross-sectional diagram of the waveguide bandpass filter 20 of FIG. 2. The waveguide bandpass filter 20 defines a passage 56 between the two flanges 22A and 22B through which electromagnetic waves of a desired frequency can travel. In accordance with the present invention, the passage 56 is absent any fixed projections or fixed protrusions that extend within the passage 56 to form coupling elements between resonant cavities. More specifically, there are no fixed irises, posts or walls that are integrally formed, soldered, or otherwise fixed in place within the passage 56. Instead, only the plurality of adjustable projections 48 extend into the passage 56. In accordance with the present invention, the resonant cavities $\mathbf{54}_{1\text{-}3}$ (which will be collectively referred to as resonant cavities 54) that reflect waves of a desired frequency are formed between adjacent ones of the coupling projections 50. For example, resonant cavity $\mathbf{54}_1$ is formed between coupling projections $\mathbf{50}_1$ and $\mathbf{50}_2$, and resonant cavity $\mathbf{54}_2$ is defined between coupling projections $\mathbf{50}_2$ and $\mathbf{50}_3$, etc. As such, the coupling projections 50 have the dual functionality of forming the coupling elements for the resonant cavities 54 and being adjustable for trimming the couplings between the resonant cavities 54.

In accordance with the present invention, the coupling projections 50 form capacitive coupling elements between the resonant cavities 54.

Positioned between each adjacent pair of coupling projections 50 is a tuning projection 52, such that the coupling projections 50 and the tuning projections 52 are positioned along the length of the passage 56 in an alternating fashion. The tuning projections 52 are operative for trimming the resonance frequency of respective ones of the resonant cavities 54. More specifically, each respective one of the tuning projections $\mathbf{52}_{1\text{-}3}$ is operative for trimming the resonance frequency of its associated resonant cavity $\mathbf{54}_{1\text{-}3}$. For example, tuning projection $\mathbf{52}_1$ is responsible for trimming the resonance frequency of resonant cavity $\mathbf{54}_1$ and tuning projection $\mathbf{52}_2$ is responsible for trimming the resonance frequency of resonant cavity $\mathbf{54}_2$.

The number of coupling projections 50 and the number of tuning projections 52 can vary without departing from the spirit of the invention. However, the number of tuning projections 52 will generally be one less than the number of coupling projections 50, since there is typically only one tuning projection 52 per resonant cavity 54. Depending on the number of coupling projections 50, the waveguide bandpass filter 20 will have a different number of poles. For example, in the case of the waveguide bandpass filter 20 shown in FIG. 3, there are three resonant cavities 54, which means that the waveguide bandpass filter 20 is a three pole filter. The three pole filter is formed by four coupling projections 50 (namely coupling projections $\mathbf{50}_{1\text{-}4}$). Therefore, a three pole filter has three resonant cavities 54 that are formed by four coupling projections 50. The number of resonant cavities for a particular waveguide bandpass filter involves a trade-off in performance. Adding cavities or resonators increases isolation in close spaced frequencies, but also increases group delay, size, and cost of the filter. The number of resonant cavities 54 that are desirable within a waveguide bandpass filter would be known to a person of skill in the art, and as such will not be described in more detail herein.

In general, the filter function of a waveguide filter, such as waveguide filter 20, is determined on a basis of the length of the resonant cavities 54 contained within the waveguide filter 20, and the penetration depth of the coupling elements 50. In accordance with the present invention, the penetration of the coupling projections 50 can be adjusted. Furthermore, the tuning projections 52 can be adjusted in order to compensate for a non-perfect length of a resonant cavity 54. The adjustable coupling projections 50 and the adjustable tuning projections 52 thus allow fine-tuning of the filter function of a waveguide filter.

In the non-limiting embodiment shown, the adjustable projections 48 (namely the coupling projections 50 and the tuning projections 52) are depicted as being threaded rods with nuts attached exterior to the waveguide housing 40. In the industry, these types of threaded rods and nuts are sometimes referred to as screws. However, in an alternative embodiment, these threaded rods and nuts could have been depicted as more traditional screws that have a fixed head instead of a nut. Any manner of projection that extends through one of the wide walls 42 of the housing 40 into the passage 56, and that can be extended into, or retracted from, the passage 56 in an adjustable manner, is included within the scope of the present invention.

The adjustable projections 48 can range in size depending on the size of the waveguide bandpass filter 20. The appropriate size of the adjustable projections 48 would be known to a person of skill in the art, and as such will not be described in extensive detail herein. In accordance with a non-limiting example, the adjustable projections 48 may be of any size ranging from 0.75 mm in diameter to 10 mm in diameter. It should also be appreciated that both the coupling projections 50 and the tuning projections 52 may be of the same size, or alternatively, the coupling projections 50 and the tuning projections 52 may be of different sizes. For example, the coupling projections 50 may have a greater diameter than the tuning projections 52, or vice versa. In general, the size of the screws that are used will depend on the size of the waveguide. For example, in the case of a WR28 waveguide, 080 screws will be used having a diameter of 60 thousands of an inch. It would be known to a person of skill in the art the appropriate size of screws to be used for a given size of waveguide filter.

In order for the adjustable projections 48, such as the screws or threaded posts, to extend within the passage 56 of the housing 40, a plurality of pre-defined apertures $\mathbf{58}_{1\text{-}7}$ (which will be collectively referred to as apertures 58) are formed into the housing 40 for receiving the plurality of adjustable projections 48. The apertures 58 can be formed in any manner known in the art, such as by drilling or punching the apertures 58 into at least one of the wide walls 42 of the housing 40. The apertures 58 may be threaded apertures, or non-threaded apertures, depending on the type of projection 48 that will be inserted within the apertures 58. The size of the pre-defined apertures 58 is determined, at least in part, on a basis of the size of the adjustable projections 48 that will extend through the apertures 58. In general, the housing 40 of the waveguide bandpass filter 20 is provided with an odd number of pre-defined apertures 58, such that when the adjustable projections 48 are inserted within the pre-defined apertures 58, there is one less tuning projection 52 than coupling projections 50.

In general, the adjustable projections are threaded, so as to provide good contact within apertures 58. The better the contact, the less insertion loss is created. In certain cases, part of the adjustable projections 48, such as the part that extends within the passage 56 can be smooth. The adjustable projections 48 may be made of stainless steel or copper, among other possible materials, and in certain circumstances the adjustable projections 48 may be silver plated in order to provide for less insertion loss.

Figure 4:
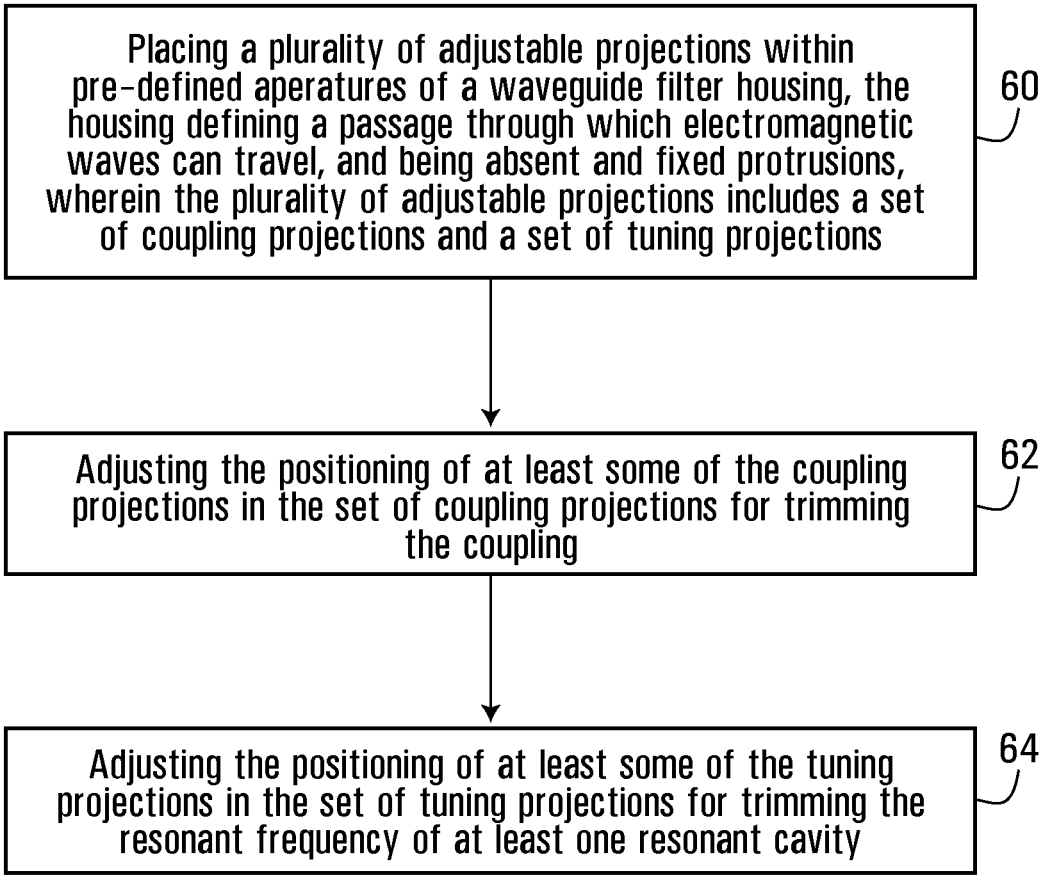
FIG. 4 shows a flow diagram of a non-limiting method for trimming the waveguide bandpass filter according to the present invention.

Given that the housing 40 is absent any fixed projections or protrusions, the waveguide bandpass filter 20 according to the present invention is relatively easy and inexpensive to manufacture. A non-limiting flow diagram of a manner of manufacturing and tuning waveguide bandpass filters 20 in accordance with the present invention will now be described in more detail with reference to the flow diagram of FIG. 4.

At step 60, the method comprises placing a plurality of adjustable projections 48 into pre-defined apertures 58 of a waveguide filter housing 40. As described above, the housing 40 defines a passage 56 through which electromagnetic waves can be transmitted and is absent any fixed protrusions or fixed projections within the passage 56. The pre-defined apertures 58 extend through at least one of the wide walls 42, such that they extend from an exterior surface of the housing 40 to an interior surface of the housing 40. In the non-limiting embodiment shown in FIGS. 2 and 3, the pre-defined apertures 58 are formed along a common axis that runs along one of the wide walls 42 of the housing 40. However, and as will be described in more detail below, it is possible for the pre-defined apertures 58 to be formed in both of the wide walls 42 that oppose one another.

The plurality of adjustable projections that are placed within the pre-defined apertures 58 comprise a set of coupling projections 50 and a set of tuning projections 52. Within the pre-defined apertures $\mathbf{58}_1$ and $\mathbf{58}_7$ that are closest to the flanges 22*a*, 22*b*, are placed coupling projections $\mathbf{50}_1$ and $\mathbf{50}_4$. The remaining tuning projections 52 and coupling projections $\mathbf{50}_2$ and $\mathbf{50}_3$ are then placed in the remaining pre-defined apertures 58 in an alternating fashion. As such, there is one less tuning projection 52 than there are coupling projections 50. As mentioned above, resonant cavities 54 are defined between adjacent ones of the coupling projections 50.

Once the adjustable projections 48 have been placed within the pre-defined apertures 58, the waveguide bandpass filter 20 needs to be tuned. The tuning may be performed to compensate for construction/manufacturing tolerances, and in order to obtain a desired filter response. The couplings between the resonant cavities 54 need to be trimmed, and the resonant frequencies of the resonant cavities 54 also need to be trimmed. At step 62, the positioning of at least some of the coupling projections 50 is adjusted for trimming the resonant cavity couplings of at least some of the resonant cavities 54. This adjustment takes place by extending or retracting the coupling projections 50 within the passage 56, such that either more of the projection 50 is positioned within the passage 56, or less of the projection 50 is positioned within the passage 56. In the case where the coupling projections 50 are coupling screws (or some other form of threaded projection), their positioning can be adjusted by rotation within the pre-defined aperture 58 such that they either extend into, or retract from, the passage 56.

It should be understood that all of the coupling projections 50 included within the waveguide bandpass filter 20 can be adjusted such that they extend further into, or retract from, the passage 56 so as to obtain a desired coupling characteristic for the waveguide bandpass filter 20. Alternatively, only some of the coupling projections 50 included within the waveguide bandpass filter 20 can be adjusted. In certain circumstances, it may not be necessary to adjust all of the coupling projections 50, as adjusting only some of the coupling projections 50 may achieve the desired coupling characteristic and filter response for the waveguide bandpass filter 20.

By trimming the coupling between resonant cavities 54, the filtering response can be adjusted. In general, a good coupling between resonant cavities 54 will achieve a relatively flat passband. While overcoupling can increase the bandwidth, it can also achieve rippling in the passband. Undercoupling can reduce the bandwidth available. Accordingly, trimming of the couplings is necessary in order to obtain a desired filtering response.

At step 64, the positioning of at least some of the tuning projections 52 is adjusted for trimming the resonant frequency of at least some of the resonant cavities 54. This adjustment takes place by extending or retracting the tuning projections 52 within the passage 56, such that either more of the projection is positioned within the passage 56, or less of the projection is positioned within the passage 56. In the case where the tuning projections 52 are tuning screws (or some other form of threaded projection), their positioning can be adjusted through rotation within the pre-defined apertures 58 such that the projections 52 either extend into, or retract from, the passage 56.

In general, when a tuning screw is retracted from within the resonant cavity, the capacitive component of the circuit is decreased, thereby increasing the resonant frequency. Conversely, when the tuning screw is extended farther into the resonant cavity the capacitive component is increased thereby decreasing the resonant frequency. In this manner the resonant frequency can be trimmed by the tuning screws.

It should be understood that the positioning of all the tuning projections 52 can be adjusted in order to trim the frequency of each resonant cavity 54 within the waveguide bandpass filter 20, or alternatively, only some of the tuning projections 52 can have their positioning adjusted for trimming the resonant frequency.

In certain cases, it is desirable to manufacture multiple ones of the same waveguide bandpass filter 20 in order to obtain multiple waveguide filters that provide the same filtering function. In such a case, once the desired filtering function for one waveguide bandpass filter 20 has been achieved by adjusting the positioning of at least some of the coupling projections 50 and some of the tuning projections 52, the positions of the adjustable projections 48 (which includes the position of both the coupling projections 50 and the tuning projections 52) relative to the passage 56 are noted, such that these positions can act as a starting point for the tuning of subsequent ones of the waveguide bandpass filters 20.

In the embodiment described above with respect to FIGS. 2 and 3, the plurality of adjustable projections 48 are all positioned along the same wide wall 42 of the waveguide bandpass filter 20. However, in alternative embodiments, the adjustable projections 48 may be distributed over both wide walls 42.

Figure 5:
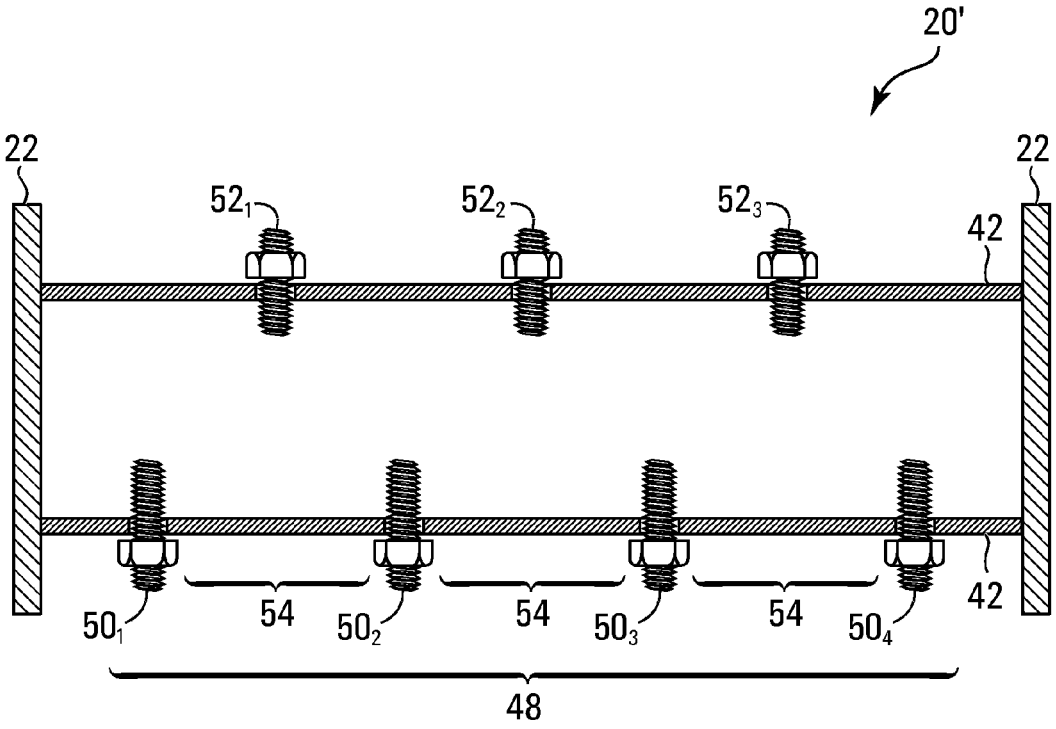
FIG. 5 shows a cross-sectional view of a second non-limiting example of implementation of a waveguide bandpass filter in accordance with the present invention.
Figure 6:
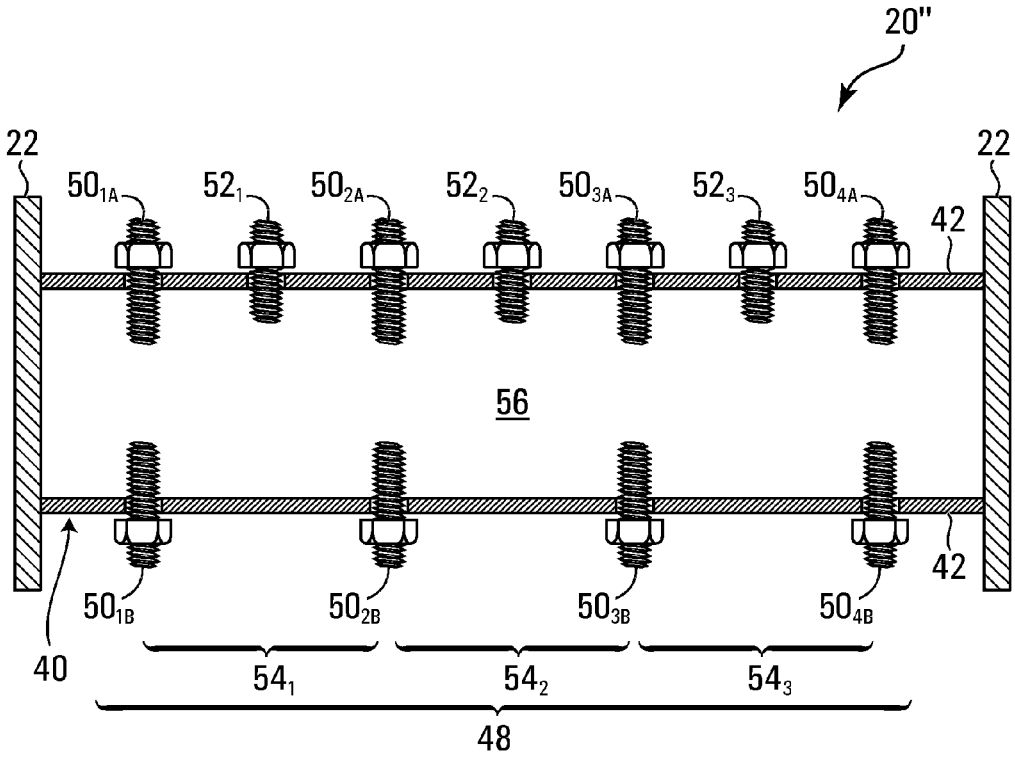
FIG. 6 shows a cross-sectional view of a third non-limiting example of implementation of a waveguide bandpass filter in accordance with the present invention.
Figure 7:
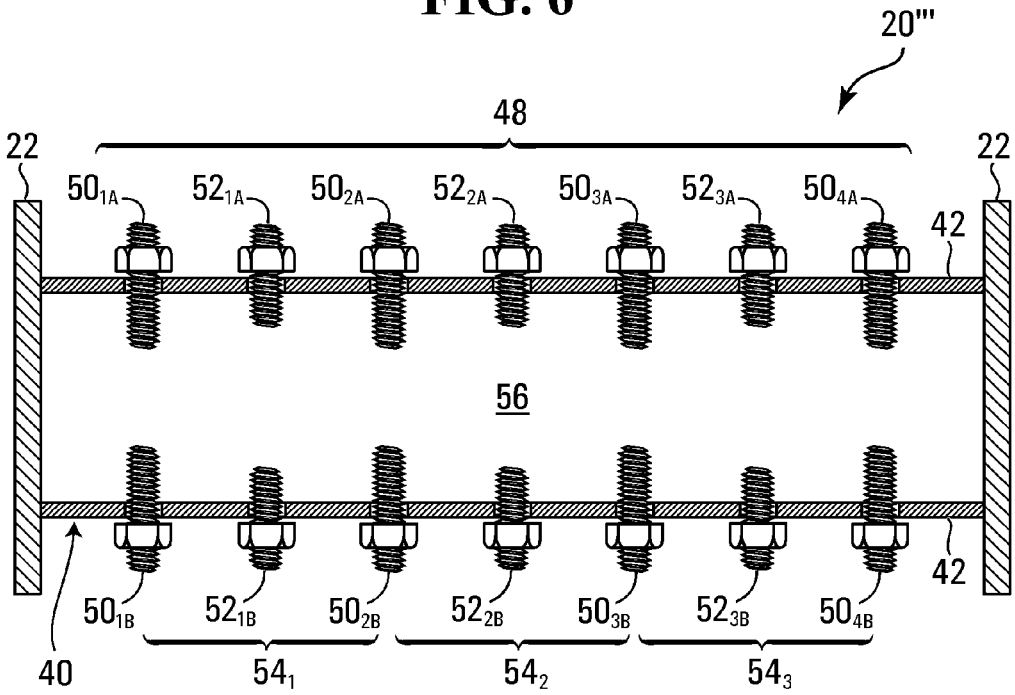
FIG. 7 shows a cross-sectional view of a fourth non-limiting example of implementation of a waveguide bandpass filter in accordance with the present invention.

Shown in FIGS. 5, 6 and 7 are alternative non-limiting examples of waveguide bandpass filters 20', 20" and 20'" in accordance with the present invention. For ease of understanding, the components described above with respect to waveguide bandpass filter 20, will be described using the same reference numbers.

As shown in FIG. 5, waveguide bandpass filter 20' comprises a plurality of adjustable projections 48. The plurality of adjustable projections 48 comprises a set of coupling projections $\mathbf{50}_1$-$\mathbf{50}_4$ (collectively referred to as coupling projections 50) and a set of tuning projections $\mathbf{52}_1$-$\mathbf{52}_3$ (collectively referred to as tuning projections 52). However, instead of all of the adjustable projections 48 being positioned on a single one of the wide walls 42 of the housing 40, the set of coupling projections 50 are positioned on one of the wide walls 42 and the set of tuning projections 52 are positioned on the opposite wide wall 42. The resonant cavities 54 are still positioned in-between adjacent ones of the coupling projections 50. The coupling projections 50 have the dual function of forming coupling elements for the resonant cavities 54 and are adjustable for trimming the coupling between neighboring resonant cavities 54. The tuning projections 52 are operative for trimming the resonant frequencies of the resonant cavities 54.

In the embodiment shown in FIG. 6, the waveguide bandpass filter 20" comprises a plurality of adjustable projections 48. The plurality of adjustable projections 48 comprises a set of coupling projections $\mathbf{50}_{1a}$, $\mathbf{50}_{1b}$, $\mathbf{50}_{2a}$, $\mathbf{50}_{2b}$, $\mathbf{50}_{3a}$, $\mathbf{50}_{3b}$, $\mathbf{50}_{4a}$ and $\mathbf{50}_{4b}$ (collectively referred to as coupling projections 50) and a set of tuning projections $\mathbf{52}_{1\text{-}3}$ (collectively referred to as tuning projections 52). However, in this embodiment, the coupling projections 50 extend through both of the wide walls 42. More specifically, at a given location along the length of the housing 40, instead of having a single coupling projection, two coupling projections are positioned at the given location. Each one of the two coupling projections extends through a different one of the two wide walls 42 such that they extend into the passage 56 of the housing 40 in a facing relationship. For example, coupling projections $\mathbf{50}_{1a}$ and $\mathbf{50}_{1b}$ are located at the same position along the length of the housing 40 and extend through opposing ones of the wide walls 42 towards each other. This is the same for coupling projections $\mathbf{50}_{2a}$ and $\mathbf{50}_{2b}$, $\mathbf{50}_{3a}$ and $\mathbf{50}_{3b}$, etc.

In accordance with the embodiment shown in FIG. 6, a coupling element between two resonant cavities 54 is formed by a pair of coupling projections 50, such that the resonant cavities 54 are formed between adjacent pairs of coupling projections 50. For example, resonant cavity $\mathbf{54}_1$ is positioned between the pair of coupling projections $\mathbf{50}_{1a}$, $\mathbf{50}_{1b}$ and the pair of coupling projections $\mathbf{50}_{2a}$, $\mathbf{50}_{2b}$. In order to trim a coupling for a resonant cavity 54, one or both of the coupling projections in the pair of coupling projections that are positioned at the same location along the length of the housing 40 are adjusted. More specifically, in the case of the coupling element formed by coupling projections $\mathbf{50}_{1a}$, $\mathbf{50}_{1b}$ the coupling can be trimmed by adjusting the extent to which one or both of these coupling projections $\mathbf{50}_{1a}$, $\mathbf{50}_{1b}$ extends within the passage 56. The tuning projections 52 are operative for trimming the resonant frequencies of the resonant cavities.

In the case where the coupling elements are formed by a pair of coupling projections, such as coupling projections $\mathbf{50}_{1a}$, $\mathbf{50}_{1b}$, each of the two coupling projections $\mathbf{50}_{1a}$, $\mathbf{50}_{1b}$ penetrates into the passage 56 less than if only one coupling projection was used. Less penetration provides better insertion loss for the waveguide bandpass filter 20".

In the embodiment shown in FIG. 7, the waveguide bandpass filter 20'" also comprises a plurality of adjustable projections 48. The plurality of adjustable projections 48 comprises a set of coupling projections $\mathbf{50}_{1a}$, $\mathbf{50}_{1b}$, $\mathbf{50}_{2a}$, $\mathbf{50}_{2b}$, $\mathbf{50}_{3a}$, $\mathbf{50}_{3b}$, $\mathbf{50}_{4a}$ and $\mathbf{50}_{4b}$ (collectively referred to as coupling projections 50) and a set of tuning projections $\mathbf{52}_{1a}$, $\mathbf{52}_{1b}$, $\mathbf{52}_{2a}$, $\mathbf{52}_{2b}$, $\mathbf{52}_{3a}$ and $\mathbf{52}_{3b}$ (collectively referred to as tuning projections 52). In this embodiment, there are both coupling projections and tuning projections that extend through both of the wide walls 42. More specifically, at a given location along the length of the housing 40, instead of having a single coupling projection, two coupling projections are positioned at the given location, with each of the two coupling projections extending through a different one of the two wide walls 42 in a facing relationship. Likewise, at a position along the length of the housing 40 between two pairs of coupling projections 50, are two tuning projections 52 that each extend through a different one of the two wide walls 42 such that they extend into the passage 56 of the housing 40 in a facing relationship. For example, positioned between the coupling projections $\mathbf{50}_{1a}$ and $\mathbf{50}_{1b}$ and the coupling projections $\mathbf{50}_{2a}$ and $\mathbf{50}_{2b}$ are a pair of tuning projections $\mathbf{52}_{1a}$ and $\mathbf{52}_{1b}$.

As such, in accordance with the embodiment shown in FIG. 7, the resonant cavities 54 are formed between adjacent pairs of coupling projections 50, and the tuning of each resonant cavity 54 is performed via a pair of tuning projections 52. For example, resonant cavity $\mathbf{54}_1$ is positioned between the pair of coupling projections $\mathbf{50}_{1a}$, $\mathbf{50}_{1b}$ and the pair of coupling projections $\mathbf{50}_{2a}$, $\mathbf{50}_{2b}$. In order to trim a coupling for a resonant cavity 54, one or both of the coupling projections in either of the pair of coupling projections $\mathbf{50}_{1a}$, $\mathbf{50}_{1b}$ and $\mathbf{50}_{2a}$, $\mathbf{50}_{2b}$ are adjusted. Furthermore, in order to trim the resonant frequency of the resonant cavity $\mathbf{54}_1$, one or both of the tuning projections $\mathbf{52}_{1a}$, $\mathbf{52}_{1b}$ can be adjusted.

In the case where the coupling elements 50 are formed by a pair of coupling projections, such as coupling projections $\mathbf{50}_{1a}$, $\mathbf{50}_{1b}$, each of the two coupling projections $\mathbf{50}_{1a}$, $\mathbf{50}_{1b}$ penetrates into the passage 56 less than if only one coupling projection was used. Furthermore, by having the tuning elements 52 formed by pairs of tuning projections, such as tuning projections $\mathbf{52}_{1a}$, $\mathbf{52}_{1b}$, each of these tuning projections penetrates into the passage 56 less than if only one tuning projection was used. The reduction in the penetration of the tuning projections $\mathbf{52}_{1a}$, $\mathbf{52}_{1b}$ into the passage 56 allows better power handling for the bandpass filter 20'''.

Figure 8:
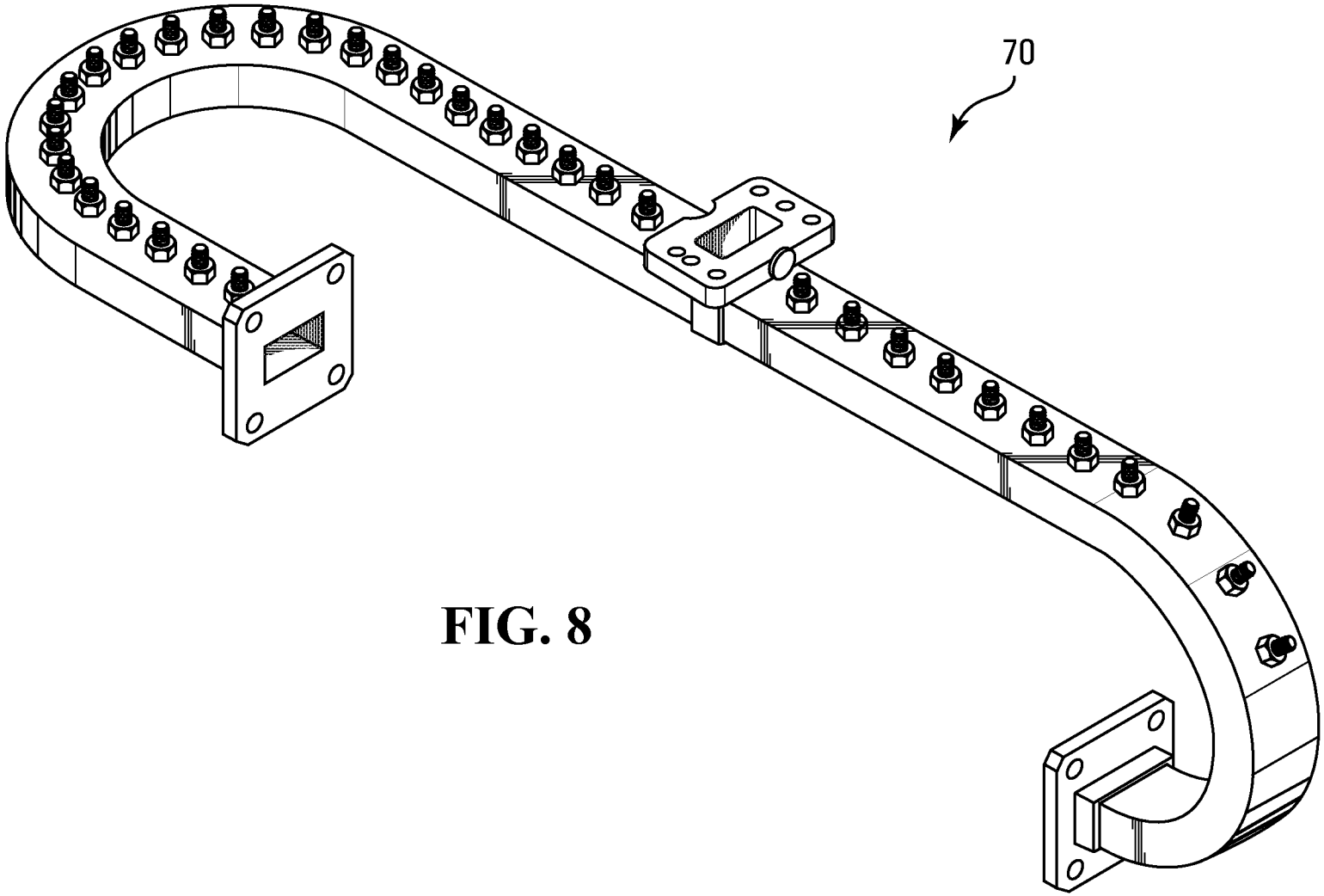
FIG. 8 shows a perspective view of a non-limiting example of implementation of a diplexer in accordance with the present invention.

The construction of the waveguide bandpass filters 20, 20', 20'' and 20''' can also be incorporated into diplexers and multiplexers for transmitting signals of a desired frequency, and eliminating waves of undesired frequencies. Shown in FIG. 8 is a non-limiting example of a diplexer 70 in which a waveguide bandpass filter according to the present invention has been integrated. The diplexer 70 includes a plurality of resonant cavities that are defined between adjustable projections, such that the adjustable projections (which can be screws, among other possibilities) have the dual functionality of forming the coupling elements between the resonant cavities and being adjustable for trimming the resonant frequencies of the resonant cavities. More specifically, the extent to which the adjustable projections extend into the wave transmitting passage (that is free of fixed protrusions) can be adjusted for trimming the coupling of the resonant cavities and the resonant frequencies of the resonant cavities.

Although in the examples described above, the waveguide bandpass filters are three pole filters, it should be understood that in alternative embodiments, the waveguide bandpass filters can have any number of resonant cavities for defining any number of poles. The bandwidth, and the steepness of the skirts or transition regions, may be modified on a basis of the number of resonant cavities. In general, an increase in the number of poles will increase the steepness of the skirts.

Figure 9:
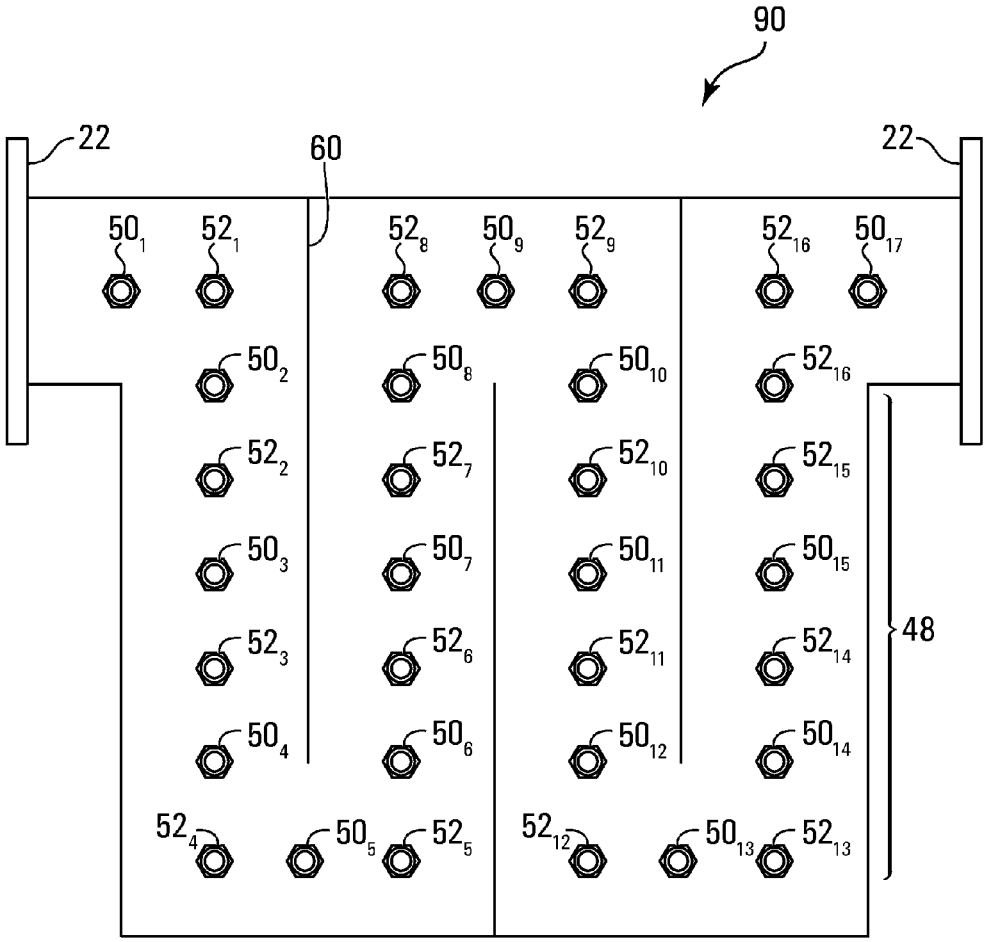
FIG. 9 shows a top plan view of a non-limiting example of a folded waveguide bandpass filter in accordance with the present invention.

Shown in FIG. 9 is a non-limiting example of implementation of a folded waveguide filter 90 that comprises a plurality of adjustable projections 48, as described above. The folded waveguide filter 90 comprises two flanges 22 on either end for connecting the folded waveguide filter 90 to other microwave components in a waveguide assembly. The waveguide filter 90 also comprises three waveguide walls 60 for forming the "folds" in the waveguide filter 90. It should be understood that any number of waveguide walls 60 could have been included in the waveguide filter 90 without departing from the scope of the present invention. The waveguide passage that is created by the exterior walls of the waveguide filter 90 and the waveguide walls 60 is absent any fixed protrusions. In the same manner as described above, the plurality of adjustable projections 48 comprise a plurality of coupling projections 50 (namely seventeen coupling projections in the embodiment shown) and a plurality of tuning projections 52 (namely sixteen tuning projections). The coupling projections 50 form coupling elements for the resonant cavities of the waveguide filter. As such, the coupling projections 50 have the dual functionality of forming the coupling elements for the resonant cavities and being adjustable for trimming the couplings between the resonant cavities. The tuning projections 52 are able to trim the resonant frequency of a given resonant cavity.

As shown in FIG. 9, a waveguide filter having adjustable projections 48 that form both coupling projections 50 and tuning projections 52, according to the present invention, can take on a variety of different shapes and configurations.

Figure 10:
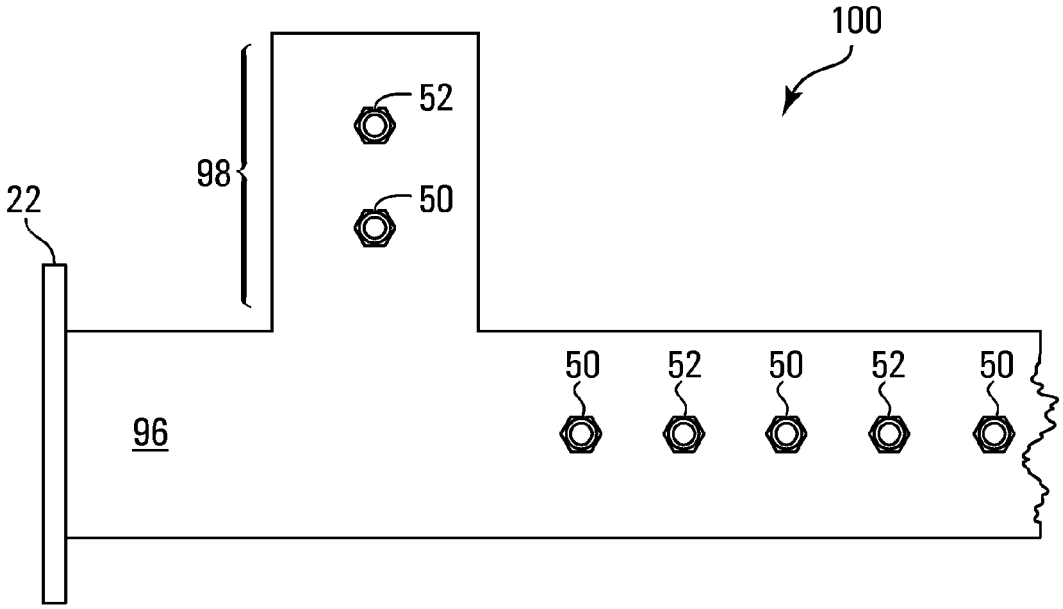
FIG. 10 shows a top plan view of a non-limiting example of an extracted pole filter in accordance with the present invention.

Shown in FIG. 10 is a non-limiting example of a portion of an extracted pole filter 100 that comprises a plurality of adjustable projections 48, as described above. The extracted pole filter 100 comprises an appendage filter section 98 that extends in a substantially perpendicular direction to a main passage 96 of the extracted pole filter 100. The appendage filter section 98 creates transmission function zeros in the filter function of the waveguide filter 100, which helps to make the signal rejection sharper. This can be desirable in a number of circumstances.

As shown, the extracted pole filter 100 comprises a plurality of adjustable projections 48. In the same manner as described above, the plurality of adjustable projections 48 comprise a plurality of coupling projections 50 and a plurality of tuning projections 52. The coupling projections 50 form coupling elements for the resonant cavities of the extracted pole filter 100. As such, the coupling projections 50 have the dual functionality of forming the coupling elements for the resonant cavities and being adjustable for trimming the couplings between the resonant cavities. The tuning projections 52 are able to trim the resonant frequency of a given resonant cavity.

Although the present invention has been described in considerable detail with reference to certain preferred embodiments thereof, variations and refinements are possible without departing from the scope of the invention. Therefore, the scope of the invention should be limited only by the appended claims and their equivalents.

What is claimed is:

1. A waveguide filter, comprising:

a) a set of coupling screws defining a plurality of resonant cavities, wherein adjacent coupling screws in the set of coupling screws define therebetween respective resonant cavities of the plurality of resonant cavities, each coupling screw in the set of coupling screws forming a coupling element for a respective resonant cavity of the plurality of resonant cavities and being adjustable for trimming a coupling of that respective resonant cavity;

b) tuning screws positioned between adjacent coupling screws in the set of coupling screws, the tuning screws being adjustable for trimming respective resonance frequencies of the plurality of resonant cavities; and c) a housing defining a passage through which waves can travel, the set of coupling screws and the set of tuning screws extending through the housing into the passage, wherein the passage comprises a substantially rectangular cross-section with first and second wide walls positioned opposite one another and first and second narrow walls positioned opposite one another, wherein at least a first coupling screw of the set of set of coupling screws extends into the passage from the first wide wall of the housing and at least a second coupling screw of the set of coupling screws extends into the passage from the second wide wall of the housing, such that the first coupling screw and the second coupling screw are positioned opposite each other in a facing relationship.

2. The waveguide filter of claim 1, wherein the coupling screws of the set of coupling screws form capacitive coupling elements.

3. The waveguide filter of claim 1, wherein the passage is absent any fixed protrusions.

4. The waveguide filter of claim 1, wherein the set of coupling screws and the sot of tuning screws are inserted into pre-defined apertures in the housing of the waveguide filter.

5. The waveguide filter of claim 1, wherein the tuning screws extend through the first wide wall of the housing into the passage.

6. The waveguide filter of claim 1, wherein the tuning screws extend through the second wide wall of the housing into the passage.

7. The waveguide filter of claim 1, wherein each coupling screw in the set of coupling screws is adjustable for trimming a coupling by extending or retracting the coupling screw into the passage of the housing.

8. The waveguide filter of claim 1, wherein each one of the tuning screws is adjustable for trimming a resonance frequency by extending or retracting the tuning screw into the passage of the housing.

9. A waveguide filter, comprising:

at least two resonant cavities, each resonant cavity of the at least two resonant cavities being positioned between two adjustable projections, the adjustable projections forming the coupling elements for the at least two resonant cavities and being adjustable for trimming a coupling of at least one resonant cavity of the at least two resonant cavities;

a tuning screw associated with a respective one of the at least two resonant cavities and being adjustable for trimming a resonance frequency of the associated resonant cavity;

a housing defining a passage through which waves can travel, the passage comprising a substantially rectangular cross-section defined by first and second wide walls positioned opposite one another and first and second narrow walls positioned opposite one another, wherein the at least two resonant cavities are located within the passage of the housing and wherein the passage is absent any fixed protrusions.

10. The waveguide filter of claim 9, wherein the two adjustable projections comprise coupling screws.

11. The waveguide filter of claim 10, wherein the two adjustable projections form capacitive coupling elements.

12. The waveguide filter of claim 9, wherein the adjustable projections and the tuning screws are inserted into pre-defined apertures in the housing of the waveguide filter.

13. The waveguide filter of claim 12, wherein the adjustable projections and the tuning screws extend through the first wide wall of the housing.

14. The waveguide filter of claim 12, wherein the adjustable projections extend through the first wide wall of the housing into the passage and the tuning screws extend through the second wide wall of the housing into the passage.

15. The waveguide filter of claim 9, wherein the adjustable projections are adjustable for trimming a coupling by extending or retracting the adjustable projection into the passage of the housing.

16. The waveguide filter of claim 9, wherein the tuning screws are adjustable for trimming a resonance frequency by extending or retracting the tuning screw into the passage of the housing.

17. A waveguide filter, comprising:

a) a housing defining a passage through which waves can travel, the passage being absent any fixed protrusions;

b) a plurality of adjustable projections extending through the housing into the passage, the plurality of adjustable projections comprising:

i) a set of coupling projections, wherein each pair of adjacent coupling projections in the set of coupling projections defines therebetween a resonant cavity, and wherein each coupling projection in the set of coupling projections acts as a coupling element for at least one resonant cavity and is adjustable for trimming the coupling of that at least one resonant cavity; and ii) a set of tuning projections, wherein a tuning projection from the set of tuning projections is positioned between each pair of adjacent coupling projections and is adjustable for trimming a resonance frequency of an associated resonant cavity.

18. The waveguide filter of claim 17, wherein the set of coupling projections comprises screws and the set of tuning projections comprises screws.

19. A method, comprising:

a) placing a plurality of adjustable projections within pre-defined apertures of a waveguide filter housing, the housing defining a passage through which electromagnetic waves can travel, the passage being absent any fixed protrusions, wherein the plurality of adjustable projections comprises a set of coupling projections and a set of tuning projections, wherein the set of coupling projections are placed within alternating ones of the pre-defined apertures for defining therebetween resonant cavities, and wherein the set of tuning projections are placed within the remaining pre-defined apertures located between adjacent ones of the coupling projections;

b) adjusting the positioning of at least some of the coupling projections of the set of coupling projections for trimming resonant cavity couplings of at least some of the resonant cavities; and c) adjusting the positioning of at least some of the tuning projections of the set of tuning projections for trimming a resonant frequency of at least some of the resonant cavities.

20. The method as defined in claim 19, wherein the set of coupling projections comprises adjustable screws.

21. The method as defined in claim 19, wherein the set of tuning projections comprises adjustable screws.

22. The method as defined in claim 19, wherein adjusting the positioning of at least some of the coupling projections comprises causing at least some of the coupling projections to be extended into or retracted from the passage of the housing.

* * * * *